United States Patent [19]

Ramnarace et al.

[11] 4,179,992

[45] Dec. 25, 1979

[54] PRIMER-IGNITER FOR GUN PROPELLANTS

[75] Inventors: Jawaharlal Ramnarace, Dana Point; William A. Wood, Newport Beach, both of Calif.

[73] Assignee: The United States of America as represented by the Secretary of the Army, Washington, D.C.

[21] Appl. No.: 893,637

[22] Filed: Apr. 4, 1978

[51] Int. Cl.[2] ..... F42B 19/10; F42B 5/00

[52] U.S. Cl. ..... 102/45

[58] Field of Search ..... 102/44, 45, 46, 38 R, 102/202, 203, 204, 205

[56] References Cited

U.S. PATENT DOCUMENTS

| | | | |
|---|---|---|---|
| 2,667,037 | 2/1954 | Musser et al. | 102/44 |
| 2,696,191 | 12/1954 | Sheehan | 102/46 |
| 2,995,088 | 8/1961 | Asplund | 102/202 |
| 3,392,673 | 7/1968 | King | 102/202 |
| 3,726,221 | 4/1973 | White | 102/45 |

FOREIGN PATENT DOCUMENTS

| | | | |
|---|---|---|---|
| 22354 | of 1902 | United Kingdom | 102/45 |
| 130412 | 8/1919 | United Kingdom | 102/45 |

*Primary Examiner*—Verlin R. Pendegrass

*Attorney, Agent, or Firm*—Peter A. Taucher; John E. McRae; Nathan Edelberg

[57] ABSTRACT

In small caliber ammunition, an explosive train for igniting the main propellant charge within the cartridge, said explosive train comprising a shock-sensitive percussion primer and a shock-resistant booster charge. The booster charge is formed as a single annular pellet coaxially aligned with the primer. The primer generates a jet of flame through the central hole in the booster pellet, thereby igniting the pellet to a self-heated condition sufficient to ignite the main propellant charge.

9 Claims, 2 Drawing Figures

PRIMER-IGNITER FOR GUN PROPELLANTS

BACKGROUND AND SUMMARY OF THE INVENTION

Small caliber ammunition, e.g. 25 millimeter, is sometimes ignited by an explosive train which comprises a percussion primer and shock-resistant booster charge. The primer comprises an explosive charge that is readily detonated to produce a low temperature jet of flame against the booster charge. The booster undergoes avalanche self-heating action to generate a high temperature flame against the main propellant charge.

Booster charges known to applicants are multipiece assemblies that are costly to fabricate and assemble into the cartridge. The present invention is directed to a booster charge and explosive train that may be readily fabricated and assembled into a cartridge at relatively low cost. The invention is applicable to explosive trains ignited by different types of primers, e.g. percussion primers or electric primers.

The invention described herein may be manufactured, used, and licensed by or for the Government for governmental purposes without payment to us of any royalty thereon.

THE DRAWINGS

Figure 1:
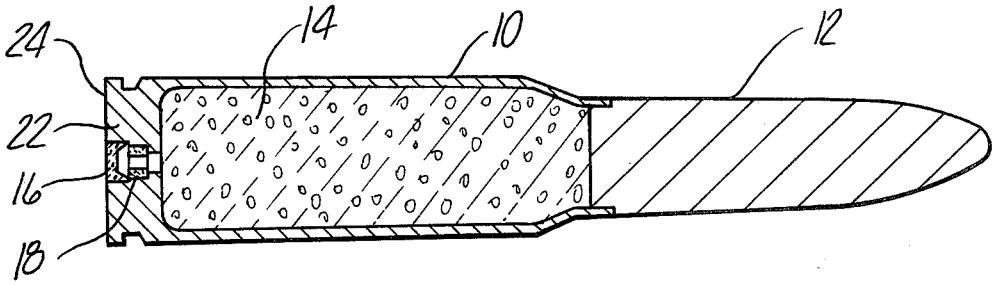
FIG. 1 is a sectional view through a round of ammunition incorporating this invention.

The ammunition round shown in FIG. 1 is a twenty five millimeter caliber round comprising a metal cartridge case 10, projectile 12, main propellant charge 14 and explosive train ignition system (in the base wall of the cartridge). The ignition system comprises a percussion primer 16 and booster charge 18.

Figure 2:
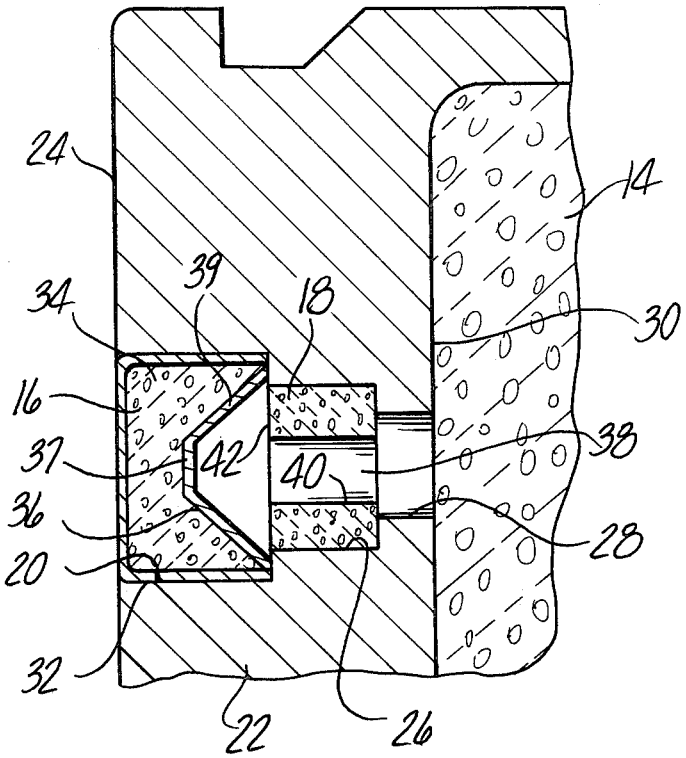
FIG. 2 is an enlarged sectional view of the explosive train ignition system used in the FIG. 1 ammunition round.

As best seen in FIG. 2, the primer is contained within a first large diameter cavity 20 extending into the cartridge casing base wall 22 from its external end face 24. Booster charge 18 is contained within a slightly smaller cavity 26 extending axially from the first cavity. A still smaller diameter passage 28 extends from cavity 26 to the inner surface 30 of the casing base wall. Each cavity 20, cavity 26, and passage 28 preferably has a circular cross section.

Percussion primer 16 is old in the art; our invention resides in the construction of booster charge 18 and its operative interconnection between the primer and the main propellant charge 14. In a typical round of ammunition the main propellant could be nitrocellulose in the form of ball-shaped pellets.

The illustrated primer includes a brass cup 32 containing a percussion primer charge 34 of finely divided explosive to the left of a bridge-like anvil 36. Charge 34 can be formed from different materials, e.g. a mixture of 55 weight % potassium chlorate and 45% lead thiocyanate. Another useful mix comprises 36 weight % lead styphnate, 12% tetracene, 22% barium nitrate, 9% lead dioxide, 7% antimony sulfide, 9% zirconium, and 5% PETN. Other primer compositions are shown in U.S. Pat. No. 3,602,283 to A. F. Schlack and U.S. Pat. No. 3,645,207 to E. S. Daniels.

The booster charge 18 in its preferred form is a single annular pellet formed of a mixture of approximately 58 weight % magnesium, 30% polytetrafluoroethylene (tradename Teflon), 7% copolymer of vinylidene fluoride and hexafluoropropylene (tradename Viton), and 5% graphite. Preferred ranges for the component materials are 50–63% magnesium, 13–33% polytetrafluoroethylene, 7–16% copolymer of vinylidene fluoride and hexafluoropropylene, and 2–9% graphite. Other possible booster compositions are black powder (potassium nitrate, sulfur and carbon), and boron potassium nitrate.

The preferred composition may be formulated by the following procedure: dissolve the copolymer of vinylidene fluoride and hexafluoropropylene in acetone to make an approximately 16% solution by weight. Transfer this solution to a mixer and slowly add the polytetrafluoroethylene, while continuing to operate the mixer at a high blade speed (so that ingredients are in a state of vortical flow; continue mixing for 2–5 minutes after the addition of the polytetrafluoroethylene. Process finely divided magnesium through sieves so that all of the particles are in the 10–20 micron size range (magnesium powder smaller than 10 microns is extremely hazardous to handle). Slowly add the finely divided magnesium to the aforementioned solution, and continue mixing for 2–5 minutes thereafter. While the mixer continues to run at high speed add hexane slowly until the solution begins to thicken; at that point stop the addition of hexane but let the mixer run for 2 minutes to continue precipitation reaction. Wash the precipitate with sufficient hexane to maintain at least 2.5 parts hexane to 1 part acetone; run the mixer during the wash operation (for at least 5 minutes). Allow the precipitate to settle and decant the liquid. Repeat the washing-decanting operation, and oven-dry the precipitate at about 120° F. for about forty eight hours; the solvent should then be completely evaporated. Then blend the dry mixture with the graphite, and compress the final mixture into the annular pellet configuration shown in FIG. 2. The Viton acts as a binder to maintain structural stability of the pellet during handling and insertion into cavity 26. The graphite helps the powder to flow easily for processing of pellets by Stokes-type automatic press. Graphite increases the burning rate and also allows the pellet to break up easily on ignition and showers the main charge with hot carbon particles to aid ignition.

The preferred booster composition functions somewhat similarly to the propellant charges shown in U.S. Pat. Nos. 3,463,682 and 3,765,334 and 3,732,132. The principal advantages of the preferred booster composition are high heat output, safety in manufacture and handling, fast burning action, high flame temperature, non-hygroscopic character (for storage), and non-corrosive reaction products. The magnesium is believed to react with the fluoride in the following fashion:

$$2Mg + CF_2 \rightarrow MgF_2 + C_{(s)} + Mg_{(g)}$$

Excess magnesium vapor reacts with available oxygen to form harmless magnesium oxide gas as follows:

$$Mg_{(g)} + O \rightarrow MgO$$

Booster pellet 18 has a central hole 38 whose diameter is approximately the same as the thickness of the primer reaction products produced by primer 16. Primer action is conventional: firing pin stroke on the end wall of cup 32 produces a frictional crush initiation between the anvil 36 on the primer charge 34. As the hot particle initiation product generated by primer 16 advances rightwardly it passes through central hole 38 in booster pellet 18, thereby heating and igniting the pellet edge surface 40 defined by the hole; peripheral portions of the flame and hot particles strike the upstream face 42 of the pellet to enhance the pellet ignition process.

The annular configuration of the booster pellet is believed advantageous in that pellet ignition takes place at surfaces 40 and 42 which communicate with passage 28 and the main propellant charge 14. Pellet flame immediately enhances and reinforces the flame jet produced by primer charge 34. The pellet initially acts as a nozzle for directing the jet of flame toward the main propellant charge 14; as the pellet ignites the still hotter flame is fed through hole 38 and passage 28 to achieve quick reliable ignition of the main charge. The action is somewhat different than that of conventional primer-booster systems housed within elongated flash tubes; in such conventional systems the pellet (or loose powder) is required to break apart or perforate in order to form a path for flame travel from the source to the main target charge. With the explosive train ignition system shown in FIG. 2 the hole 38 in the booster pellet immediately forms a flame transmission path to the target charge 14.

Booster pellet 18 may be formed in various sizes. However advantageous results have been achieved with a pellet having a major diameter of about 6 millimeters, a hole diameter of about 2 millimeters, and an axial thickness of about 4 millimeters. Passage 28 had a diameter of about 4 millimeters and a length of about 2 millimeters. Passage 28 preferably has a diameter only slightly smaller than the diameter of cavity 26 so that the booster pellet is adequately supported on the cavity rear (right) wall without causing passage 28 to excessively restrict or retard the flame jet.

As previously noted, the booster 18 is preferably formed as a single annular pellet, rather than a loose powder charge. Pelletizing the charge is advantageous in such respects as easy production loading into cavity 26 by automatic equipment, precise weight control of the booster charge, and homogenous pyrotechnic composition free from indeterminate voids or breakages that produce non-uniform heating. The booster pellet is preferably housed within a cavity in the cartridge base 22, thereby avoiding the expense of the separate flash tube usually employed. Pellet construction and energy amount and release is such that a relatively small pellet can be employed for a given ignition effect. Ultimate advantage of this invention is low overall cost for the explosive train ignition system.

We wish it to be understood that we do not desire to be limited to the exact details of construction shown and described for obvious modifications will occur to a person skilled in the art.

We claim:

1. In a small caliber ammunition cartridge casing having a base and a tubular side wall extending therefrom: an explosive train for igniting the main propellant in the cartridge, comprising a first large diameter cavity extending into the casing base from its external face, a second slightly smaller cavity extending axially from the inner limit of the first cavity, and a still smaller passage extending axially from the second cavity to the inner surface of the casing end wall; a percussion type primer seated in the first cavity for generating a flame and hot particles in the direction of the second cavity; and a shock-resistant booster charge of annular configuration in the second cavity for receiving the flame front generated by the primer; said booster charge having a central hole therethrough of a diameter slightly smaller than the aforementioned passage, whereby the generated flame impinges on the inner edge surface of the hole as said flame moves toward the passage.

2. The explosive train of claim 1 wherein the booster charge is a single annular pellet having approximately the same axial thickness as the second cavity.

3. The explosive train of claim 1 wherein the primer is constructed to generate a flame and hot particles of approximately the same width as the diameter of the hole in booster charge.

4. The explosive train of claim 1 wherein the passage has a diameter only slightly smaller than the diameter of the cavity whereby the booster charge is supported within the cavity without excessively restricting the flame jet during movement thereof through the passage.

5. The explosive train of claim 1 wherein the primer includes a conical anvil arranged with its apex remote from the booster charge in axial alignment with the central hole, whereby the primer is caused to direct a narrow flame of hot particles through the hole.

6. The explosive train of claim 1 wherein the booster charge comprises an annular pellet that is made of a mixture of finely divided magnesium, polytetrafluoroethylene, a copolymer of vinylidene fluoride and hexafluoropropylene, and graphite.

7. The explosive train of claim 6 wherein the booster charge has a weight composition of approximately 50–63% magnesium, 13–33% polytetrafluoroethylene, 7–16% copolymer of vinylidene fluoride and hexafluoropropylene, and 2–9% graphite.

8. The explosive train of claim 1 wherein the booster charge is a single annular pellet having a major diameter of about 6 millimeters, a hole diameter of about 2 millimeters, and an axial thickness of about 4 millimeters.

9. The explosive train of claim 8 wherein the passage has a diameter of about 4 millimeters and a length of about 2 millimeters.

* * * * *